United States Patent [19]

Loty

[11] 4,012,657

[45] Mar. 15, 1977

[54] SLIT-SCANNING IMAGE CONVERTER TUBE

[75] Inventor: Charles Loty, Limeil-Brevannes, France

[73] Assignee: Commissariat a l'Energie Atomique, Paris, France

[22] Filed: Sept. 8, 1975

[21] Appl. No.: 611,198

[30] Foreign Application Priority Data

Sept. 13, 1974 France ..... 74.31136

[52] U.S. Cl. ..... 313/99; 250/213 VT

[51] Int. Cl.[2] ..... H01J 39/04; H01J 39/18

[58] Field of Search ..... 313/99, 102, 94, 381, 313/453; 250/213 VT

[56] References Cited

UNITED STATES PATENTS

| | | | |
|---|---|---|---|
| 3,796,901 | 3/1974 | Mayer et al. | 313/99 X |
| 3,864,595 | 2/1975 | Lawrence et al. | 250/213 VT X |

*Primary Examiner*—Robert Segal

*Attorney, Agent, or Firm*—William R. Woodward

[57] ABSTRACT

Rapidly varying light phenomena are observed by scanning on a screen the image of a slit in a photocathode which collects the light coming from the phenomenon to be studied. The image converter tube comprises separate electronic means respectively for forming the image of the longest dimension of the slit on the screen and for focusing and deflecting the beam in the plane of the screen in a direction at right angles to the longest dimension of the slit.

9 Claims, 9 Drawing Figures

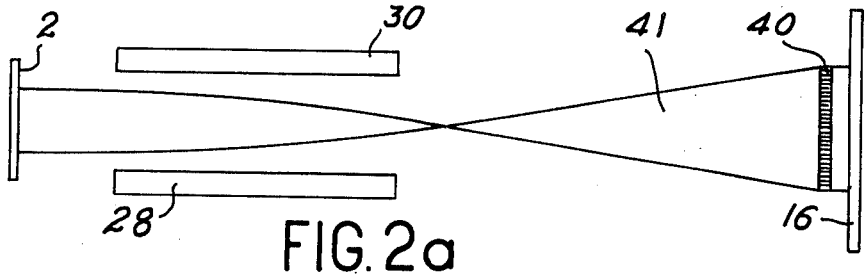
FIG. 2a
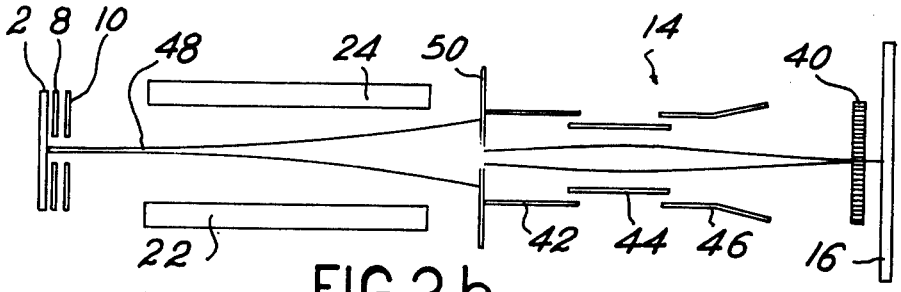
FIG. 2b
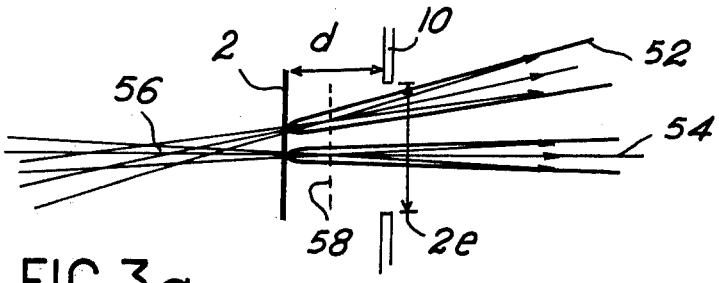
FIG. 3a
FIG. 3b
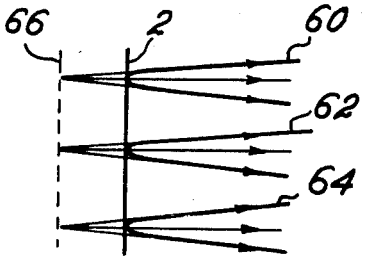

SLIT-SCANNING IMAGE CONVERTER TUBE

This invention relates to a slit-scanning image converter tube.

Recording of images with extremely short exposure times makes it possible to plot the time-variation profile of light phenomena of very short duration. Ultra-high-speed electronic motion-picture photography thus applies to a wide field of research and disciplines of a very varied nature such as ballistics, explosion engineering, study of living cells, laser experimentation and so forth.

It is known that two types of electronic camera are in use: the integral image camera which serves to record photographically two-dimensional images of phenomena to be studied, and the slit-type camera which serves to record photographically the time-variation of the light level of a one-dimensional image of the phenomena to be studied. In scanning-beam image-converter cameras of both types mentioned above, the image of the phenomenon to be studied is formed on a photocathode of an imager converter tube of conventional type comprising, in addition to the photocathode, a control electrode, accelerating electrodes, a focusing electrode, a pair of deflectors and an electroluminescent screen which may be associated with an electron multiplier device.

The number of electrons emitted at each point of the photosensitive layer of the photocathode is proportional to the level of light locally. The electrons are accelerated and focused on the plane of the screen on which a visible image is formed which may be of phosphorus, for example. When the tube is at rest, the electrons are arrested at the level of the photocathode by a negative potential applied to the control electrode. An electrical signal having a positive rectangular waveform is superimposed on the negative bias potential so as to initiate opening of the tube. The opening time is determined by the duration of the positive rectangular signal.

In the integral image camera, it is possible to produce images of small size by occulting the entrance window of the photocathode. By applying framing signals of suitable waveform to the deflectors of the optical deflecting system, it is possible to record a series of images side by side on a screen; these images are separated by a time interval which depends on the frequency of the opening signals.

In the slit-type camera, the image formed on the photocathode is delimited by a narrow aperture or slit, the image of which is formed on the screen. Displacement of the slit image in continuous motion is obtained by applying a scanning signal to the deflectors of the optical deflecting system. Progressive variation of brightness as a function of the time-duration of the light phenomenon under study is observed in the exit window of the tube, along the scanning axis. The spatial variation of the same phenomenon is recorded along the axis at right angles to the scanning axis, that is, along the longest dimension of the slit.

Image converter tubes of conventional type are equipped with an optical system of revolution. This optical system which is designed to form two-dimensional images provides optimum performance for a given distribution of potentials applied to the electrodes. The major disadvantage of an optical system of revolution lies in the fact that the spatial resolution is related to the time resolution being sought. It is known that the field of acceleration of photoelectrons must be increased in order to increase the time resolution. A homothetic variation of potentials on the electrodes cannot be contemplated by reason of the problems presented by cold emissions and maintenance of voltage within the tube. In consequence, in optical systems of revolution, the spatial resolution will decrease as the time resolution becomes higher.

A further cause of reduction of spatial resolution within the slit camera of conventional type having an optical system of revolution arises from defocusing of the photocathode image on the screen as a result of scanning of said image in the direction of deflection. In conventional optical systems, said defocusing cannot be compensated dynamically by reason of the fact that it does not possess symmetry of revolution and that, in cameras of conventional type, the optical systems are of revolution about the axis of propagation of electrons.

The invention relates to an image converter tube which is intended to equip a slit-type scanning camera which has an advantage over the conventional slit-type scanning tube in which the optical system has symmetry of revolution in that it permits of different adjustment along two axes and therefore an optimization which is independent of the spatial resolution and of the time resolution.

In the slit tube in accordance with the invention, the two axes of the slit are differentiated (spatial axis parallel to the length of the slit and time axis perpendicular to the spatial axis); the converter tube in accordance with the invention is accordingly equipped with an electronic optical system which is optimized independently in each axis and optimization along the time axis includes the electron beam deflection system. Moreover and in accordance with the invention, this arrangement preferentially makes use of a flat photocathode.

This time and spatial resolutions of this optical system are simultaneously optimum. Said resolutions make it possible to raise the performances of slit cameras above the values obtained at the present time with conventional image converter tubes.

In more precise terms, the slit-scanning image converter tube in accordance with the invention is intended to permit observation of rapidly varying light phenomena by scanning on a screen the image of a slit in a photocathode from which is collected the light emitted (or reflected) by the light phenomenon to be studied; as in the case of an image converter tube of conventional type, said tube comprises a photocathode, a blanking electrode, at least one accelerating electrode and a screen; between the accelerating electrode and the screen, the optical system for deflecting and focusing the beam is constituted by first electronic means for forming the image of the largest dimension of said slit on the screen and by second means which are independent of the first for focusing and deflecting the beam onto the screen in a direction at right angles to the previous direction, that is, in the direction at right angles to said slit.

Focusing is thus independent in both planes, namely the deflection plane and the spatial plane. The spatial plane is parallel to the largest dimension of the slit and contains the axis of mean propagation of electrons within the tube; the deflection plane is perpendicular to the slit and contains the same axis Oz of electron propagation.

In accordance with the invention, the electronic means are, for example, a lens which is convergent in the spatial plane so as to form the image of the photocathode slit on the screen and a lens which is convergent in the deflection plane, thereby deflecting the beam in order to form on the screen and along the axis of deflection successive images either of the photocathode or of the crossover point produced by the accelerating electrode.

In accordance with a preferential embodiment of the invention, use is made of a quadrupole lens which is convergent in the spatial plane and divergent in the deflection plane in order to form the image of the photocathode on the screen in the spatial plane, and of a flat lens which is convergent in the deflection plane and calculated as a function of the divergence of the quadrupole lens aforesaid so as to permit focusing and deflection of the beam along the time axis.

Focusing along the height of the slit is performed by two combined lenses, namely a divergent lens (divergent plane of the quadrupole lens) and a convergent lens having a unidirectional action. The lens last mentioned is coupled with the deflector so as to obtain, in accordance with a preferential embodiment of the invention, a dynamic correction of the deflection defocusing.

Focusing adjustments on the slit image are facilitated by the fact that said adjustments are independent on each axis.

By virtue of an adjustment of the potential applied to the unidirectional lens, it is possible to form an image of the height of the slit or of the crossover point of this latter.

In accordance with one embodiment of the invention, the exit stage of the tube comprises an electron multiplier device, for example a microchannel wafer, a proximity-focusing acceleration space, a phosphorus screen for example which is deposited on a glass fiber exit window. This exit stage is identical in design to the one fitted on the RTC image converter tube type P 500F.

Photographic recording is carried out by direct coupling between film and exit plane of the glass fibers.

It is readily apparent that the deflection and focusing lenses are preferentially electrostatic lenses but can also be magnetic lenses.

Further properties and advantages of the invention will become more readily apparent from the following description of exemplified embodiments which are given by way of explanation without any implied limitation, reference being had to the accompanying drawings, wherein:

FIG. 1 is a perspective diagram showing one embodiment of the converter tube in accordance with the invention;

FIGS. 2*a* and 2*b* show the shape of the electron beam in the spatial plane and the deflection plane;

FIGS. 3*a* and 3*b* show the modification of the electron beam produced by the accelerating electrode in the spatial plane and the deflection plane;

FIGS. 4*a* and 4*b* are respectively a sectional view and a side view of the quadrupole lens;

Figure 1:
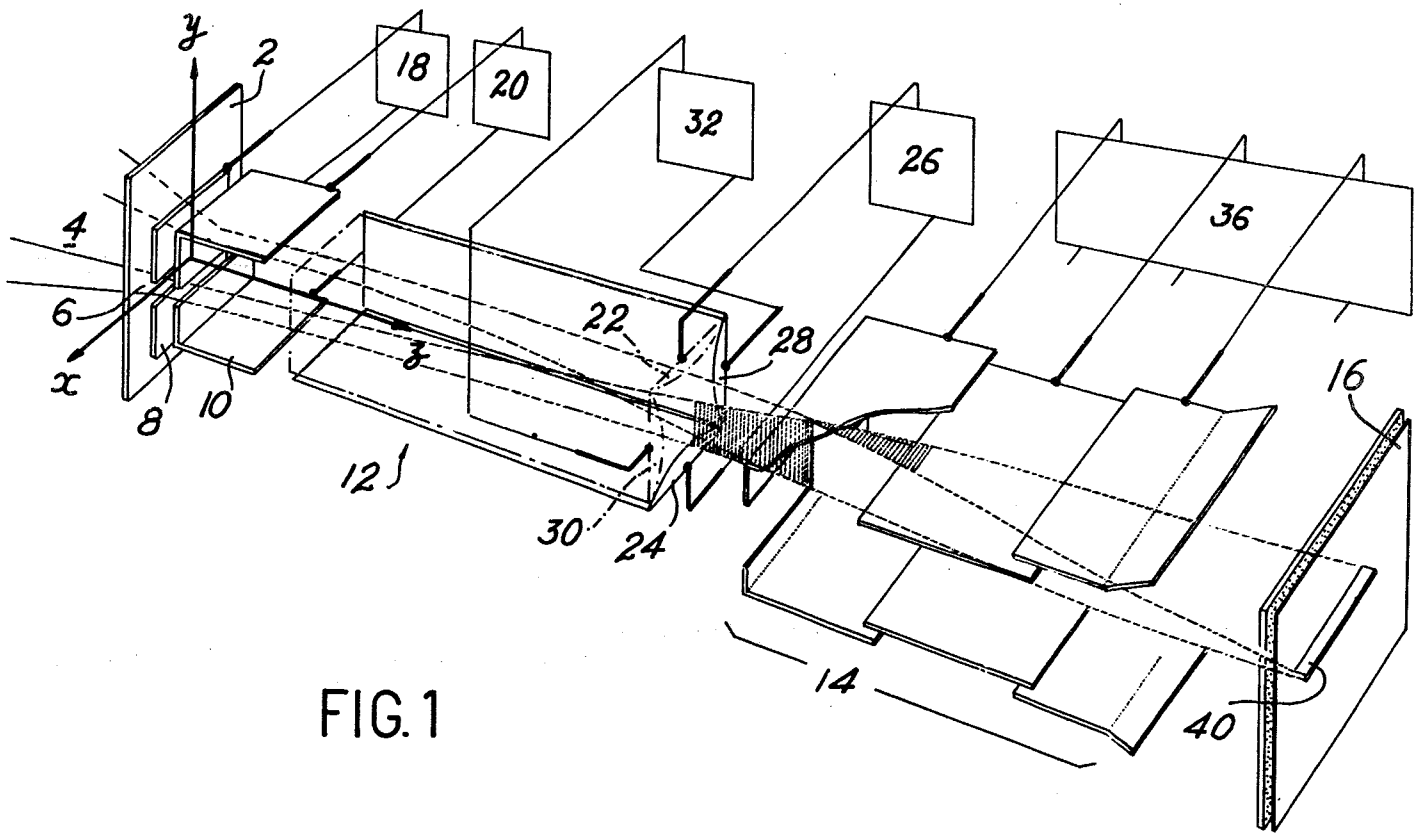

There is shown in FIG. 1 one embodiment of a converter tube in accordance with the invention. The light of the beam 4 is focused by an optical system (not shown) onto the photocathode 2 in a rectangle 6 which constitutes the electron-emitting slit. The converter tube further comprises a control electrode 8, an accelerating electrode 10, a quadrupole lens 12, a flat convergence and deflection lens 14, and a screen 16. In this embodiment, the frame and the photocathode are connected to ground, the blanking or control electrode 8 is connected to a power supply 18 which delivers a voltage signal of rectangular wave form when it is desired to initiate the operation of the tube; the accelerating electrode 10 is connected to a positive voltage source 20; the two portions 22 and 24 of the quadrupole lens 12 are connected to a common positive voltage supply 26 whereas the two other opposite portions 28 and 30 are connected to a negative voltage supply 32; the three plates of the convergence and deflection lens 14 are connected to a high-voltage supply 36.

In the spatial plane, namely the plane *x*Oz, the image of the slit 6 is produced by means of the convergent lens formed by the portions 28 and 30 of the quadrupole lens, said image being formed on the screen 16 (or on a microchannel wafer 40 in an output system comprising an electron multiplier). In the deflection plane, namely the plane *y*Oz, the lens 14 deflects the image of the photocathode onto the screen 16 in the direction O*y* (time axis).

There is shown in FIG. 2*a* the shape of the electron beam in the spatial plane between the photocathode 2 and the screen 16. In this embodiment and in accordance with a known arrangement, the electron beam passes through a microchannel wafer 40 before reaching the screen 16. The potential applied to the electrodes 28 and 30 by the supply 32 of FIG. 1 is such that the image is the spatial plane *x*Oz of the photocathode slit is formed substantially on the screen 16. The electron beam is shown at 41.

In FIG. 2*b*, there is shown the shape of the electron beam in the deflection plane *y*Oz. The electron beam 48 is initially divergent since the quadrupole lens in this plane is a divergent lens; in this embodiment, said beam is stopped-down by means of a slit 50 before penetrating into the convergence and deflection lens 14 so as to be focused on the microchannel wafer 40 which is placed in front of the screen 16. In this embodiment, the deflecting lens 14 is constituted by three pairs of plates 42, 44 and 46, the pair of plates 44 being the pair of deflecting electrodes.

In FIG. 3*a*, there are shown the photocathode 2 and the accelerating electrode 10 as well as the diagram of beams such as the beams 52 and 54 which emerge from the photocathode. The crossover point is located at 56 and the image of the photocathode produced by the electrode 10 is represented by the dashed line 58. The position of the crossover point 56, of the photocathode image 58 and the mid-height of the crossover point vary as a function of the ratio $e/d$, where $e$ is the half-width of the slit of the accelerating electrode 10 and $d$ is the distance between the photocathode and the accelerating electrode.

In FIG. 3*b*, there is shown in the spatial plane the photocathode which emits electron beams such as 60, 62 and 64, the photocathode image 66 produced by the electrode 10 in this plane being located downstream.

Figure 4A:
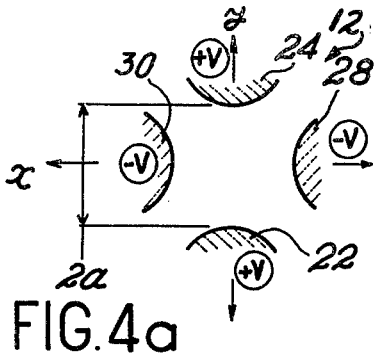
Figure 4B:
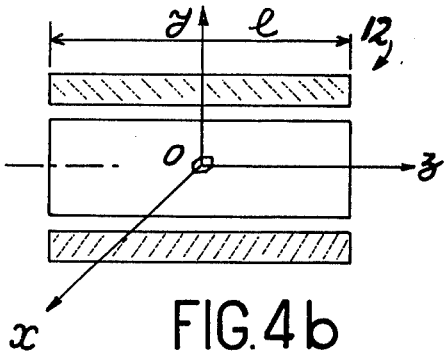

FIGS. 4*a* and 4*b* show the quadrupole lens 12. In accordance with this embodiment, said lens is formed by four acrs of equilateral hyperbola, the oppositely-facing arcs 22 and 24 being brought to the potential +V and the arcs 28 and 30 being brought to the potential −V. FIG. 4*b* shows the same quadrupole lens having a length *l* in a sectional side view taken along the plane *y*O*z*.

The potential within the interior of a lens of this type is of the form $V = A(y^2 - x^2)$; the lens is convergent in the plane *x*O*z*, $\delta V/\delta x = -2Ax$ and divergent in the plane of *y*O*z*, $\delta V/\delta y = +2Ay$.

Use is made of the property of convergence of the quadrupole lens 14 in order to form the image of the slit 6 of the photocathode 2, either on a screen or on the entrance of the microchannel wafer 40 of FIG. 1. In the spatial plane, the emergent beam from the photocathode 2 has dimensions which are not negligible with respect to the interelectrode distance 2*a*. It is therefore in the spatial plane that aberrations of the quadrupole lens will impair the quality of the image. In the deflection plane, the height of the slit being 1 mm, for example, the height of the beam will be small compared with 2*a*, namely of the order of one centimeter, and aberrations will accordingly be negligible. The advantage of the quadrupole lens over a simple convergent lens lies in the fact that it does not introduce substantial distortions in the spatial plane since it is not subject to first-order aberrations.

As has already been noted, the shape of the electrodes which serve to establish the quadrupole field is a branch of a equilateral hyperbola. Since this shape cannot readily be machined, it is replaced in an alternative embodiment of the invention by a circular arc having the same mean radius of curvature.

Figure 5:
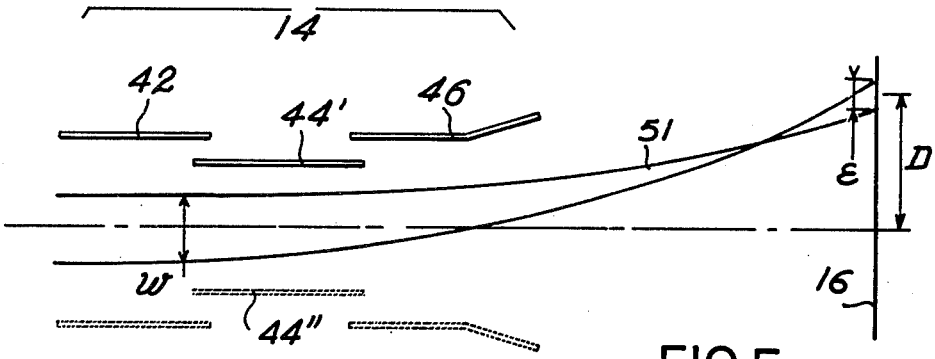
FIG. 5 shows one embodiment of a flat convergence and deflection electrode.

In FIG. 5, there is shown an embodiment of the flat lens 14 which is convergent in the deflection plane *y*O*z* and also performs the function of deflecting plate. Said lens 14 comprises three pairs of plates 42, 44 and 46. In contradistinction to the above-mentioned quadrupole lens 12, the flat lens 14 produces action only in the deflection plane and is intended to form on the entrance of the microchannel wafer (or on the screen) either the image of the slit or the image of the crossover point. The two pairs of end plates 42 and 46 are brought to the same potential $V_0$ and the two intermediate plates 44′ and 44″ are brought to a mean potential V when it is desired to direct the electron beam to the center of the target, that is, on the axis O*z*. When it is desired to deflect the beam, the plate 44′ is brought to the potential $V + \Delta V$ and the plate 44″ is brought to the potential $V - \Delta V$ and, as shown in FIG. 5, the beam is deflected upwards. The beam is designated by the reference numeral 51.

One of the major problems arising from deflection of an electron beam is defocusing. When an electron beam is deflected by means of plates brought to positive and negative potentials with respect to a mean potential, the trace is seen to increase in thickness on each side of the central position. This thickening is caused by the action of the convergent lens produced by the application of deflection voltages to the plates: the electrons which are close to the positive plates are accelerated and are less readily deflected than the axial electrons by reason of their higher velocity.

On the contrary, the electrons which are closer to the negative plates are slowed-down and therefore deflected to a greater extent, with the result that the crossing of paths takes place at a point which is undesirably close to the exit of the deflecting plates. Defocusing is measured by means of the ratio $\epsilon/w$, where $\epsilon$ is the dimension of the spot on the screen 16 and *w* is the thickness of the beam at the entrance of the deflecting plates. The three-lens system employed in FIG. 5 is a coupled focusing-deflecting system. The inner electrodes 44′ and 44″ of the flat lens are employed for deflecting the beam. This design solution offers two advantages: the distance between the deflecting plates and the screen is increased, thus reducing distortion and it is also possible to compensate for the convergence effect by means of dynamic compensation. To this end, the convergence of the lens is reduced progressively as the beam is deflected. This compensation in the tube according to the invention has no effect in the spatial plane and produces action solely in the deflection plane.

Figure 6:
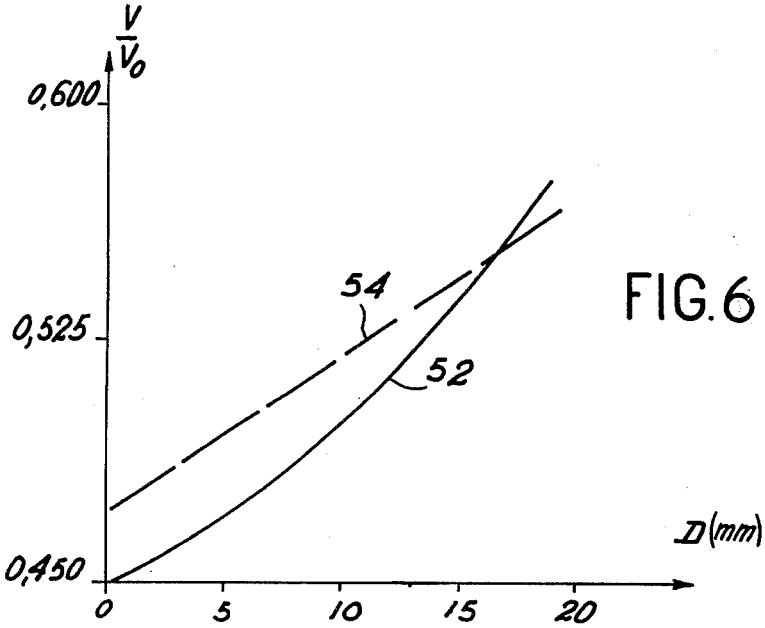
FIG. 6 is a diagram showing the voltage applied to the deflecting plates of the flat electrode so as to carry out a dynamic deflection compensation.

There is shown in FIG. 6 the variation in potential of the flat plate 44′ for example, which reduces deflection defocusing in the device shown in FIG. 5. There has been plotted as ordinates the quotient $V/V_0$ of the potential V applied to one of the plates 44′ for example and, as abscissae, the deflection distance D measured along the time axis parallel to O*y*. The reference 52 designates the theoretical curve which totally eliminates deflection defocusing. The reference 54 designates a dashed line which is technically easier to produce and conforms as closely as possible to the variation in potential represented by the curve 52, which is necessary in order to obtain perfect compensation for deflection defocusing.

This dynamic compensation is possible in accordance with the invention since the deflection planes and the spatial planes are clearly differentiated. In the prior art in which optical systems are employed with symmetry of revolution, such dynamic compensation was not possible. The advantage of this deflection compensation is to increase the spatial resolution of images to an appreciable degree. It is also demonstrated that the ratio $\epsilon/w$ which is a measurement of deflection defocusing is of lower value when provision is made for deflecting electrodes as indicated in FIG. 5, that is, when said electrodes are placed between the two focusing plates 42 and 46, than is the case when deflecting electrodes are added downstream of the convergent lens 14 alone.

The geometrical and electrical characteristics of one exemplified embodiment of the invention are as follows:

distance between photocathode and entrance of microchannel wafer: 290 mm,
dimensions of the photocathode slit: 1 × 20 mm,
dimensions of the accelerating slit *d* : 2 × 20 mm,
quadrupole lens, $l = 96.5$ mm, $a = 14.4$ mm, $l/a = 6.7$.
convergent and deflecting lens: length 29 mm; minimum interelectrode distance: 20 mm,
length of deflection space: 88 mm,
useful dimensions of the screen: 40 × 40 mm,
acceleration potential: 5000 V,
potential of the quadrupole lens: ± 219 V,
blocking potential of control electrode: − 500 V,
mean potential of the flat convergent and deflecting lens: 2163 V,
deflection sensitivity: 400 V/cm, spatial resolution in the direction of the slit: 10 pl/mm,
distortion: less than 3 %,
thickness of the trace in the deflection plane: 100 μm,
time resolution along the slit: better than 10 picoseconds.

In conclusion, the advantages provided by this type of optical system can be summarized hereunder:

in the entrance space constituted by the flat photocathode and the control and accelerating electrodes, the arrangement of the tube according to the invention ensures a homogeneous electric field on the photocathode and consequently enhanced spatial resolution, thereby permitting a high electric field on the photocathode, enhanced time resolution and facilitating technological construction.

in the optical system for the formation of the image, the image of the length of the photocathode is produced by a quadrupole lens which produces small aberrations and a very small field curvature, thus making it possible to form the image of a flat photocathode.

The image of the crossover point of the height of the slit which is produced by the conjoint action of the quadrupole lens and of the flat unidirectional convergence and deflection lens results in a larger useful photocathode surface area. It is also possible to form the two-dimensional image of the photocathode so as to meet the requirements of adjustments of image-transfer objectives.

Deflection is carried out by the flat convergent lens, thereby making it possible to reduce the length of the tube while maintaining the same angle of deflection and providing partial compensation for deflection defocusing by virtue of a suitable potential applied to the intermediate electrodes of said lens.

Moreover, the exit stage comprising microchannel wafer and proximity focusing achieves:

high adjustable photon gain without modification of the inherent characteristics of the otpical system,
a blanking factor which is higher than $10^6$.

What we claim is:

1. A slit-scanning image converter tube for the observation of rapidly varying light phenomena by scanning on a screen the image of a line source of electrons, said tube being constituted by a photocathode which collects the light coming from a light phenomenon to be studied and emits an electron beam, at least one control electrode having a slit for defining said line source of electrons in cooperation with said photocathode and for gating said line source by means of an applied control potential, at least one accelerating electrode, said screen, an electron-optical system for deflecting and focusing the electron beam and located between the accelerating electrode and said screen, wherein according to the invention said electron-optical system comprises:

astigmatic electron-optical lens means for focusing an image of said line source having resolution in the longer dimension of said line source on said screen and having no line of focus for resolution in the shorter dimension of said line source in the vicinity of said screen;

unidimensional focusing and deflecting means for focusing and deflecting said beam in the direction, parallel to said screen, of the shorter dimension of said line source, said focusing and deflecting means being located between said astigmatic lens means and said screen and cooperating with said astigmatic lens means for focusing an image of said line source having resolution in the shorter dimensions of said line source on said screen during deflection of said image by application of deflection potential to said focusing and deflection means, without disturbance of an independently adjusted focus of said astigmatic lens means for resolution of the image of said line source in the longer dimension thereof.

2. An image converter tube according to claim 1, wherein said astigmatic electron-optical lens means is constituted by a quadrupole lens and wherein said unidimensionally focusing and deflecting means is constituted by a convergent flat lens provided with beam deflection electrodes for application of deflection voltage.

3. A converter tube according to claim 2, wherein the slit in said control electrode has a rectangular shape defining perpendicular axes O*x* and O*y* respectively parallel and perpendicular to the long side of the rectangle and intersecting at the center O of said slit, wherein the accelerating electrode is provided with a slit parallel to the axis O*x*, the electron beam produced by impact of the light on the photocathode being accelerated along the axis O*z* at right angles to O*x*and O*y* by a positive potential applied to the accelerating electrode, wherein the quadrupole lens is convergent in the plane *x*O*z* or so-called spatial plane and is divergent in the plane *y*O*z* or so-called deflection plane, and wherein said convergent flat lens is convergent in the deflection plane *y*O*z* and wherein the electric power supply applies a variable voltage to said beam deflection electrodes of the flat lens in order to deflect the electron beam in the direction O*y* as a function of time.

4. A converter tube according to claim 3, wherein the photocathode is flat.

5. A converter tube according to claim 3, wherein said tube comprises means for applying a voltage to the plates of the convergent flat lens both in order to deflect the electron beam in the direction O*y* and to focus said beam on the screen with resolution in the shorter dimension of said line source so as to ensure that the image parallel to the axis O*x* of the photocathode moves in the direction O*y* during the time interval in which the electron beam traverses the blanking electrode.

6. A converter tube according to claim 3, wherein provision is made in addition for an electron multiplier device placed immediately in front of the screen.

7. A converter tube according to claim 3, wherein the quadrupole lens is constituted by four cylindrical electrodes which have generator-lines parallel to the axis O*z* and the right sections of which in a plane parallel to the plane *x*O*y* are substantially portions of equilateral hyperbolas, two oppositely-facing electrodes being brought to a positive potential and the two other oppositely-facing electrodes being brought to a negative potential.

8. A converter tube according to claim 3, wherein the quadrupole lens is constituted by four cylindrical electrodes which have generatorlines parallel to the axis O*z* and the right sections of which in a plane parallel to the plane *x*O*y* are circular arcs, two oppositely-facing electrodes being brought to a positive potential and the other two electrodes being brought to a negative potential.

9. A converter tube according to claim 3, wherein said convergent flat lens which is convergent in the deflection plane $yOz$ is constituted by three pairs of flat plates in succession, the plane of said plates being parallel to the spatial plane $xOz$ and wherein the pair of intermediate deflecting plates is supplied with a voltage having time-dependent variations such as to achieve dynamic compensation for convergence of the electron beam.

* * * * *